US005183316A

United States Patent [19]

Ottestad

[11] Patent Number: 5,183,316

[45] Date of Patent: Feb. 2, 1993

[54] MOUNTING BRACKET FOR A WORKING DEVICE

[75] Inventor: Jack B. Ottestad, La Jolla, Calif.

[73] Assignee: ESCO Corporation, Portland, Oreg.

[21] Appl. No.: 763,551

[22] Filed: Sep. 23, 1991

[51] Int. Cl.[5] ..... E21C 3/00

[52] U.S. Cl. ..... 299/69; 173/190

[58] Field of Search ..... 299/37, 69, 70, 94; 404/90, 133.2; 173/185, 190, 42; 125/6, 7, 8, 40

[56] References Cited

U.S. PATENT DOCUMENTS

| | | | |
|---|---|---|---|
| 1,830,751 | 11/1931 | Cornett . | |
| 1,830,752 | 11/1931 | Cornett . | |
| 4,667,746 | 5/1987 | Moraly | 173/89 |
| 4,697,648 | 10/1987 | Brandt | 173/28 X |
| 5,111,888 | 5/1992 | Wimmer | 173/42 |

FOREIGN PATENT DOCUMENTS

| | | | |
|---|---|---|---|
| 2194849 | 8/1972 | France | 299/70 |
| 2408017 | 7/1979 | France | 299/70 |
| 610942 | 6/1978 | U.S.S.R. | 299/37 |

*Primary Examiner*—David J. Bagnell

*Attorney, Agent, or Firm*—Banner, Birch, McKie & Beckett

[57] ABSTRACT

A mounting bracket for mounting a working device to a boom of a carrier includes a base, flanges for attaching the bracket to the boom, and ears for attaching the working device to the bracket. The ears each define a hole for pivotally coupling the working device thereto for free pivotal movement about a single axis to alleviate the generation of excessive side forces. The bracket further includes stops to limit the free angular movement so that the working device can be oriented at an inclination and so that it may be used to pry pieces of the worked material.

20 Claims, 6 Drawing Sheets

54C
40
44
60
105
73
105
94
94
90
96
98
92
98
117
111
113
99
107
107
12
10
32

MOUNTING BRACKET FOR A WORKING DEVICE

FIELD OF THE INVENTION

The present invention pertains to a mounting bracket for supporting a working device, and in particular to a mounting bracket for attaching a fluid driven hammer to a boom of a carrier.

BACKGROUND OF THE INVENTION

Fluid driven hammers as well as other working devices are commonly attached to the end of a boom for manipulation and use. Hammers are commonly used in the construction industry for the demolition of concrete, fracturing of rock, driving posts, etc. In general, a hammer 10 includes a housing or casing 12 which defines a hollow interior (FIG. 12). The interior is subdivided by an annular shoulder 20 into a rear tubular cavity 16 and a forward tubular cavity 18. Annular shoulder 20 defines a central orifice 22 interconnecting the two cavities. A piston 26 and tool 24 are movably supported in cavities 16, 18, respectively. The fluid connections have been omitted for clarity, as these are well known in the industry.

Tool 24 is typically a rigid, rod-like member which is intended to engage the ground, post, etc., and perform the desired work. For purposes of illustration only, a working tool for breaking up concrete and the like will be described. Nevertheless, a wide variety of other types of tools could be used in connection with the hammer. The illustrated tool 24 is comprised of a generally cylindrical body 28, an enlarged head 30, and a pointed free end 32. The head end 30 and the upper portion of body 28 are reciprocally received within cavity 18. Body 28 extends outwardly through opening 34 defined in the forward end of casing 12, so that working end 32 is exposed for engaging the bearing surface, such as concrete C. Orifice 22 and opening 34 each define a smaller width than that defined by head 30, to thereby confine head 30 within cavity 18. Alternatively, a pin is used to confine the tool instead of enlargement 30.

Piston 26 is comprised of a generally cylindrical body segment 36 and an impact segment 38. Body segment 36 is matingly received within rear cavity 16 of casing 12 for reciprocal movement therewithin. Impact segment 38 as illustrated protrudes forwardly from body 36 with a reduced diameter. Nevertheless, the piston is frequently constructed as a uniform cylindrical member throughout its length. In any event, impact segment 38 is received through orifice 22 during the forward end of each stroke. In use, piston 26 is rapidly reciprocated within cavity 16 to repeatedly strike working tool 24. Specifically, impact segment 38 is driven through orifice 22 to repeatedly strike head 30, which in turn imparts an impact force to the bearing surface (such as concrete C) by pointed end 32. The movement of piston 26 is caused by selectively feeding pressurized hydraulic fluid or air into cavity 16 on opposing sides of piston 26. The control of the fluid is effected by a pump and a plurality of valves (not shown).

Preferably, head 30 of tool 24 is abutted against shoulder 20 when struck by piston 26, to maximize the force of each blow. The downward force applied by the boom to which the hammer is attached is intended to present the tool in this position for each impact. However, due to the limitations of manipulating a boom and the construction of prior art mounting brackets, the optimum operation is often not realized.

In a typical operation of a fluid driven hammer prior to the present invention, tool 24 begins the operation with head 30 engaged against shoulder 20 (FIGS. 12 and 13A). In this position, tool 24 receives the maximum impact force from the reciprocated piston 26. During operation, the casing 12 is intended to follow tool 24 after each blow so that head 30 is in contact with shoulder 20. However, in practice, the downward pressure applied by the boom to casing 12 is not sufficient to overcome the friction between casing 12 and tool 24 to allow shoulder 20 to rest against the tool. Hence, a gap is produced between shoulder 20 and head 30 (FIGS. 13B and 14). This situation often becomes aggravated so that the head gradually progresses farther and farther away from shoulder 20 before each successive impact of piston 26. As can be appreciated, this causes the piston to impact the working tool 24 at successively lower positions in its downstroke. As piston 26 travels downwardly past the optimal striking point (i.e., where head 30 abuts shoulder 20), it begins to slow down. As a result, less force is imparted to tool 24 each time head 30 fails to return to shoulder 20. In fact, the farther head 30 is separated from shoulder 20, the less force it receives from piston 26. In certain instances, the problem can become so acute that piston 26 does not even strike tool 24 (FIG. 13C).

This shortcoming is primarily the result of the tool experiencing excessive friction. The magnitude of the friction is a function of the bearing material, lubricants, and side loads generated during operation. Side loads are caused when tool 24 and casing 12 are not in axial alignment with each other (FIG. 14). The magnitude of the side loads varies depending upon the nature and characteristics of the bearing material and the direction of the force applied to the hammer by the boom. In the prior art, the force applied to the hammer has tended to create, rather than avoid, the generation of such side forces.

In the construction industry, a number of different carriers are provided with articulated booms. For illustration purposes only, the boom of a backhoe will be discussed; although other types of booms and carriers could be used. A typical backhoe boom 40 includes a pair of arms 42, 44 (FIG. 15). First arm 42 is pivotally attached at its proximate end 42 to carrier 48, and its remote end to second arm 44. Second arm 44 (commonly referred to as the "stick") projects outwardly from first arm 42 and supports hammer 10 on its free end 52. The movement of articulated boom 40 is effected by a series of hydraulic cylinders 54A–C. More specifically, the first hydraulic cylinder 54A is attached between carrier 48 and first arm 42 for controlling the vertical pivotal movement of first arm 42 indicated by arrow 56. Cylinder 54B is connected between first arm 42 and second arm 44 for pivoting second arm 44 in a vertical direction as indicated by arrow 58. Hammer 10 is then pivotally swingable via the operation of hydraulic cylinder 54C working in combination with the box end linkage 60. The pivotal sweeping motion of hammer 10 is generally indicated by arrows 62.

Mounting brackets 65 are typically used to attach the hammer or other working device to the boom. One known mounting bracket is shown in FIG. 11. In this construction, bracket 65 includes a base plate 67, a pair of mounting flanges 69, and a pair of mounting ears 71. Mounting flanges 69 extend outward from base plate 67 and are spaced apart to receive therebetween the end of the stick 44 and a brace 73 of box end linkage 60. Each flange 69 further defines a pair of spaced apart bores (not shown) which are aligned with corresponding bores (not shown) in the stick and brace, respectively. Pins 79 are received through the aligned bores to couple bracket 65 to boom 40. Mounting ears 71 extend from the side of base plate 67 opposite mounting flanges 69. Ears 71, like flanges 69, are spaced apart and each define a pair of spaced apart bores (not shown). Ears 71 receive therebetween a pair of side plates 85 welded or otherwise secured to the sides of casing 12 of hammer 10. Each side plate also defines a pair of bores (not shown) which are aligned with the bores of ears 71. Pins 87 are received through the aligned bores of side plates 85 and ears 71 to couple hammer 10 to bracket 65.

Cylinder 54C is operable to swing hammer 10 about pin 79 received through flange 69 and stick 44. This causes the hammer to be moved in a sweeping motion such that the pointed end 32 of tool 24 is moved along an arc. In fact, with this construction, the working end 32 is moved the greatest distance of any of the components with each adjustment of cylinder 54C. As a result, a small adjustment of the cylinder can result in a large displacement of the working end 32. As can be appreciated, operation of the other cylinders 54A, 54B also causes the hammer to be swept in an arc about a pin positioned more rearward along the boom. This type of adjustment makes accurate placement of the working end a difficult task.

As discussed above, it is intended that tool 24 be positioned at its fully retracted position (i.e., with head 30 engaged against shoulder 20) to receive each successive piston blow (FIGS. 12 and 13A). This positioning of tool 24 is accomplished by the downward force which is applied by boom 40. However, in view of the multiple articulation of the boom, a direct forward axially applied pressure to hammer 10 is virtually impossible to attain, even for an experienced operator. As best seen in FIGS. 14 and 15, expansion of hydraulic cylinder 54C functions to arcuately swing working end 32 rather than apply a downward force thereto. While this arcuate swinging could theoretically be compensated for by cylinders 54A, 54B, it as a practical matter is not generally successfully achieved. Therefore, as tool 24 becomes embedded in bearing material C, the force applied by cylinder 54C tends to increasingly bind casing 12 against tool 24 (FIG. 14). This operation thus creates the excessive side forces commonly experienced in the prior art.

SUMMARY OF THE INVENTION

The present invention pertains to a mounting bracket specially designed to overcome the shortcomings of the prior art.

In particular, the present mounting bracket secures the hammer or other working device to a boom by a single pivot pin. With this construction, the tool is mounted for a free swinging motion to permit an axial load to be applied to the hammer by the boom, without causing binding between the casing and the tool. Accordingly, the generation of side forces is largely alleviated.

The single pin mounting construction further enables the tool to be easily manipulated to its proper position. More specifically, due to its single pin mounting construction, the hammer tends to naturally orient itself in a vertical position, irrespective of the specific position of the boom and mounting bracket. This arrangement, thus, permits the operator to easily position the working end of the tool at the appropriate place on the bearing surface. This operation stands in sharp contrast with the laborious swinging adjustment commonly associated with the prior art.

The present mounting bracket also includes a pair of spaced apart stops which define outer limits to the free pivotal movement of the hammer. These stops selectively abut the hammer at certain positions to enable the operator to orient the hammer at different inclinations.

DETAILED DESCRIPTION OF THE PREFERRED EMBODIMENTS

Figure 1:
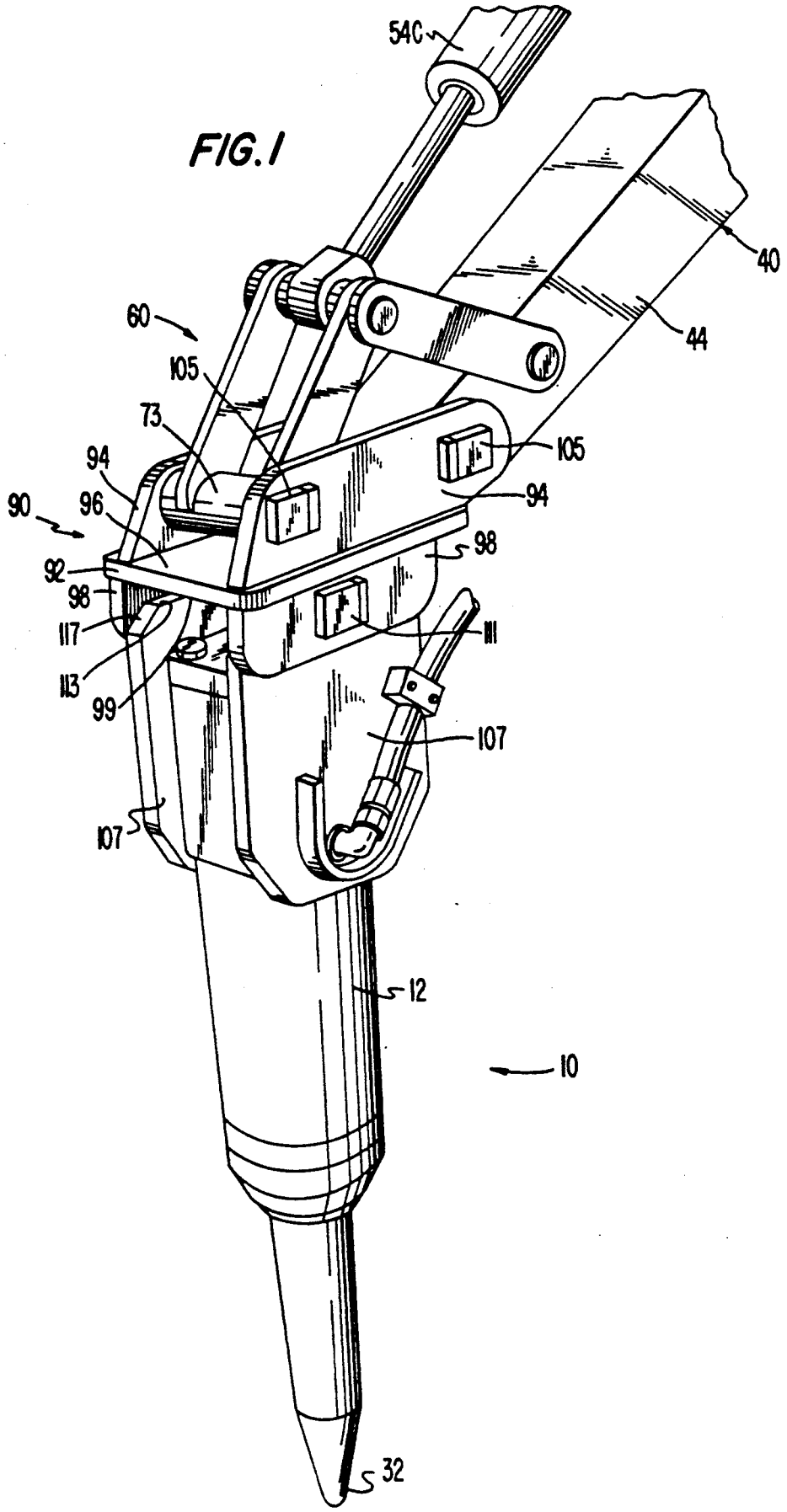
FIG. 1 is a perspective view of a mounting bracket of the present invention coupling a hammer to the end of a boom.
Figure 3:
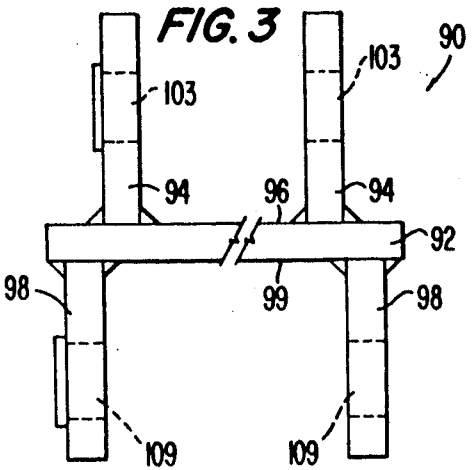
FIG. 3 is an end elevational view of the present mounting bracket.
Figure 2:
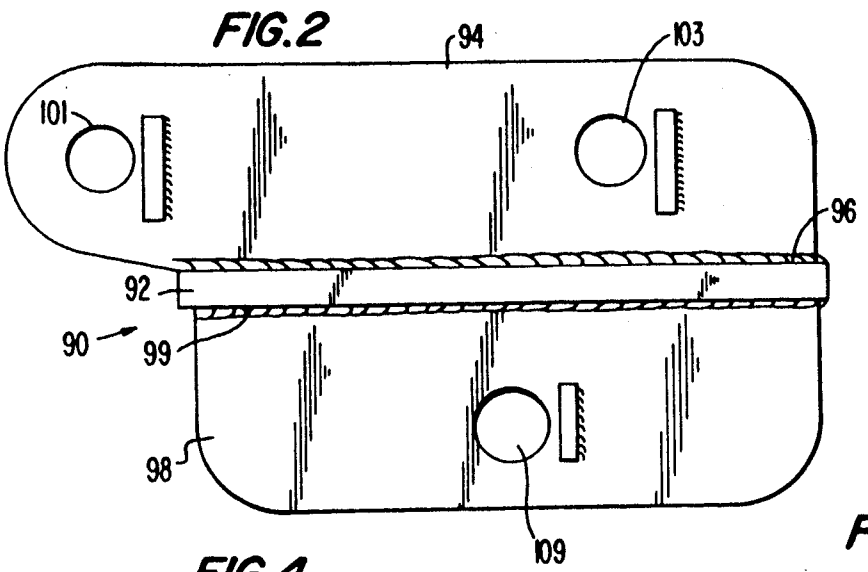
FIG. 2 is a side elevational view of the present mounting bracket.

The mounting bracket 90 of the present invention is designed to couple a working device, such as a hammer, to the end of a boom for easier adjustment and use than heretofore available (FIGS. 1–3). For illustration purposes only, the mounting bracket 90 will be discussed in connection with securing a fluid driven hammer to the boom of a backhoe. Nonetheless, a mounting bracket in accordance with the present invention could be used in connection with a wide variety of other working devices and carriers.

In the preferred construction, mounting bracket 90 includes a base plate 92, a pair of mounting flanges 94 extending from a first side 96 of plate 92 in one direction, and a pair of mounting ears 98 extending from a second side 99 of plate 92 in an opposite direction. Mounting flanges 94 are spaced to receive the sides of the stick 44 and brace 73 of boom 40. Each mounting flange 94 defines a pair of spaced apart holes 101, 103 adapted to be aligned with corresponding holes (not shown) in the stick 44 and brace 73, respectively. Pins 105 are received into the aligned holes to movably couple mounting bracket 90 to the end of boom 40. In like manner, ears 98 are spaced to receive therebetween a pair of side plates 107 which are welded or otherwise attached to the sides of casing 12 of hammer 10. Each mounting ear 98 defines a single central hole 109. Holes 109 are aligned with a corresponding hole (not shown) defined in each of the side plates. Alternatively, side plates 107 could be omitted, and the holes defined within the casing of the hammer itself. A pin 111 is received in the aligned holes to pivotally couple hammer 10 to mounting bracket 90. Pins 105, 111 are matingly received into their respective holes for enabling relative pivotal motion of the coupled components. Hole 109 and pin 111 are preferably substantially aligned with the center of gravity of the hammer, so that the hammer will naturally assume a vertical orientation.

Figure 9:
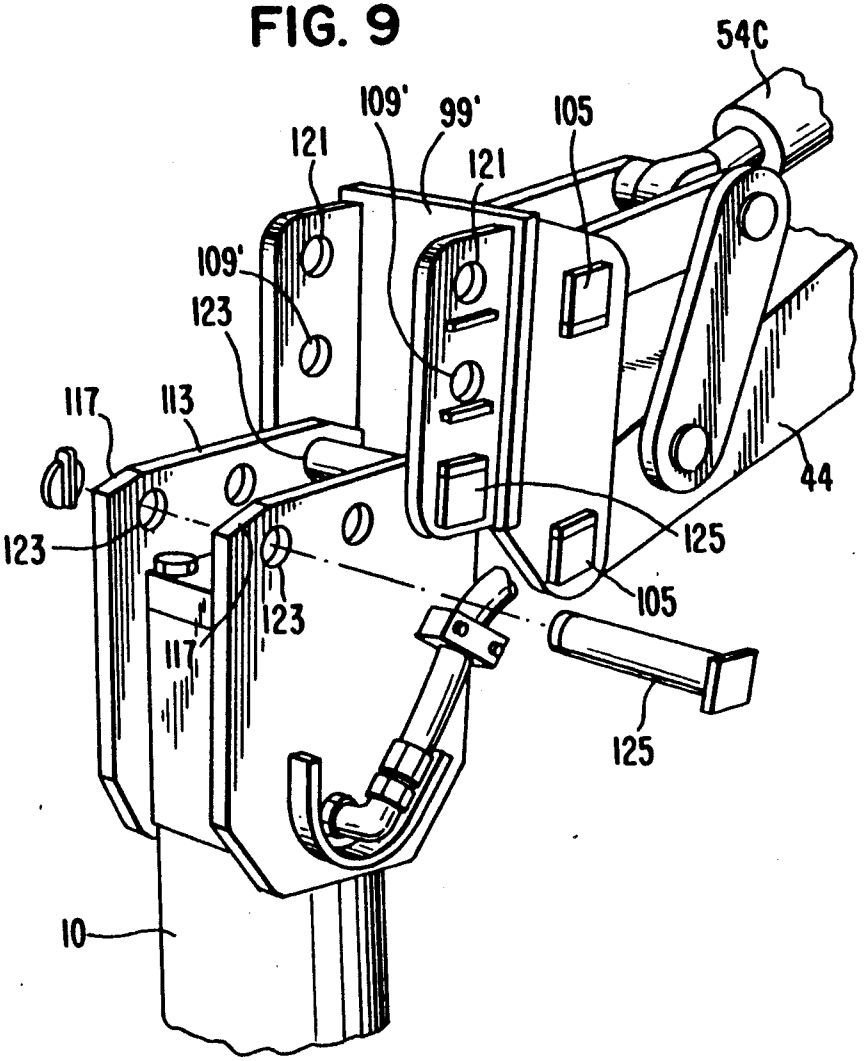
FIG. 9 is a perspective view of the alternative embodiment adjusted for service of the supported hammer.

Side plates 107 preferably have a generally rectangular shape; although many shapes could be used. As best seen in FIGS. 1 and 9, each side plate defines an upper edge 113. Each of the edges 113 defines a central segment 115 and a pair end segments as stops 117. Stops 117 are inclined relative to central segment 115 so as to slope away from base plate 92 at a particular angle. Stops 117 function to limit the free angular movement of the hammer about pin 111. More specifically, stops 117 are oriented to abut against corresponding stop portions of the second side 99 of base plate 92 upon sufficient movement of the hammer. The angular orientation of the stops 117 and the spacing of the upper edges 113 from base plate 92 determines the angular range of movement for hammer 10. In the preferred construction, the hammer has a range of movement of about 15° to either side of the center line (i.e., 30° altogether). Nevertheless, other ranges could be provided. Stops 117 enable the hammer to be positively oriented at a position other than vertical.

Figure 4:
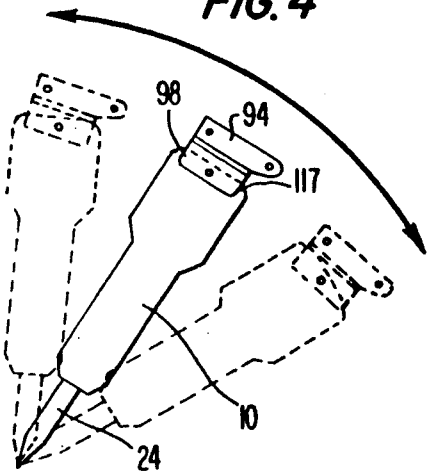
FIG. 4 is a schematic side view illustrating the adjustment capabilities of the present invention.

When using mounting bracket 90, the operator may adjust the boom so that the hammer is free to assume a vertical orientation (i.e., with stops 117 disengaged from base plate 92). In this position, the operator may adjust the boom so that the working end 32 is placed over the desired point of contact with the surface to be worked. In contrast with the prior art mounting brackets, adjustment of cylinders 54A–54C does not swing the working end in an arc and thus magnify the displacement, so long as the movement stays within the limits of the stops. Once, the working point has been placed on the surface of the concrete C or other material, the hammer may easily be oriented at the desired inclination by adjusting the boom (FIG. 4). Specifically, the boom may be adjusted to swing the mounting bracket relative to the working end, so that the hammer assumes the desired inclination. As can be appreciated, this process works well with a generally flat working surface.

Figures 5, 6A, 6B, 6C, 10A, 10B:
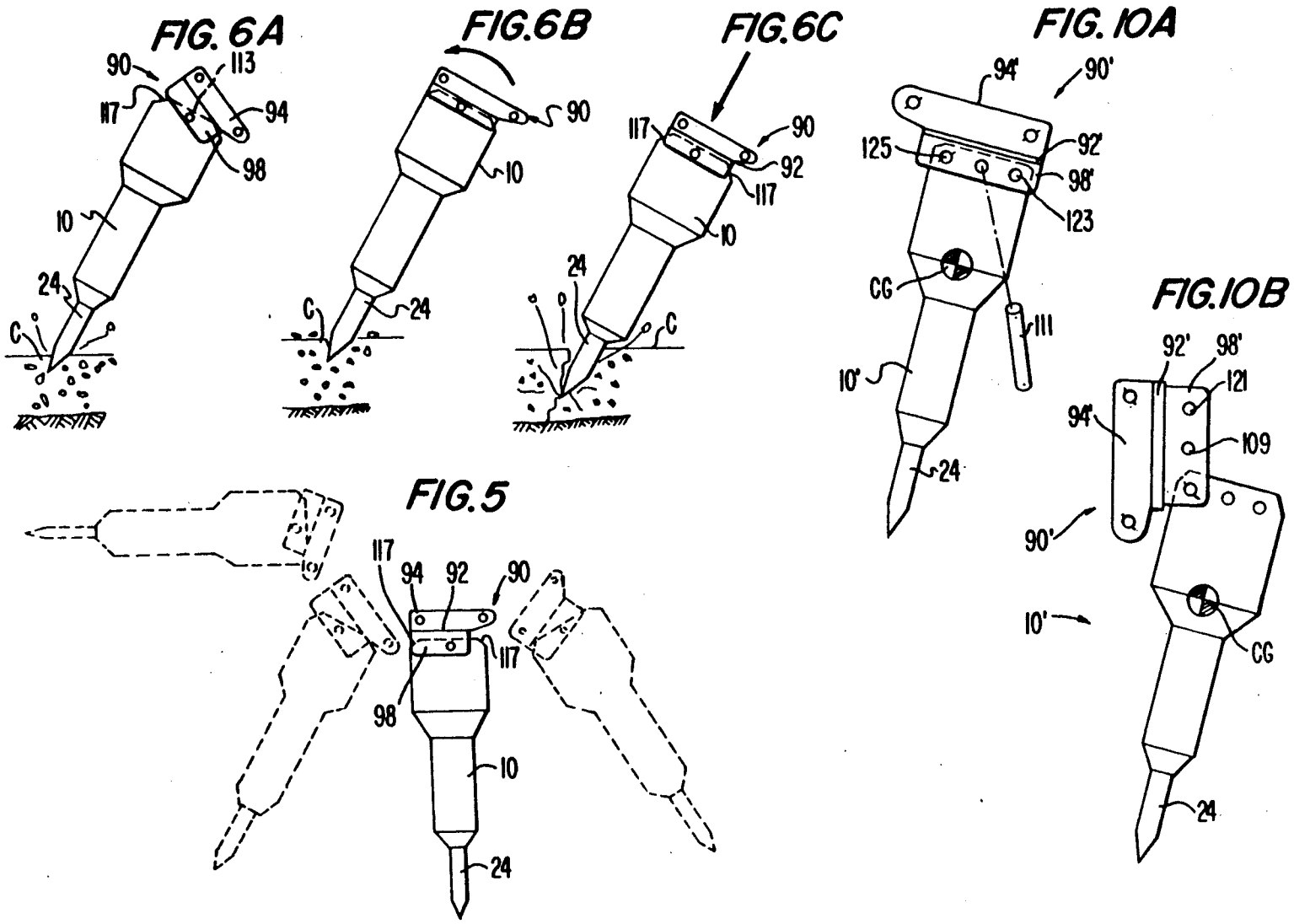
FIG. 5 is a schematic side view illustrating an alternative adjustment process for the present invention.
FIGS. 6A–6C are schematic side views illustrating a method of using the present invention.
FIGS. 10A and 10B are schematic side views of steps to place the mounting bracket of the alternative embodiment into a service mode.

Alternatively, the hammer may be oriented at an inclination prior to the placement of the working end 32 against the surface (FIG. 5). In this process, cylinders 54A–54C are adjusted to swing the mounting bracket around relative to the hammer until one set of the stops engages the respective stop portions of base plate 92. With stops 117 abutted against plate 92, the hammer will swing with the mounting bracket to its desired orientation.

Figure 14:
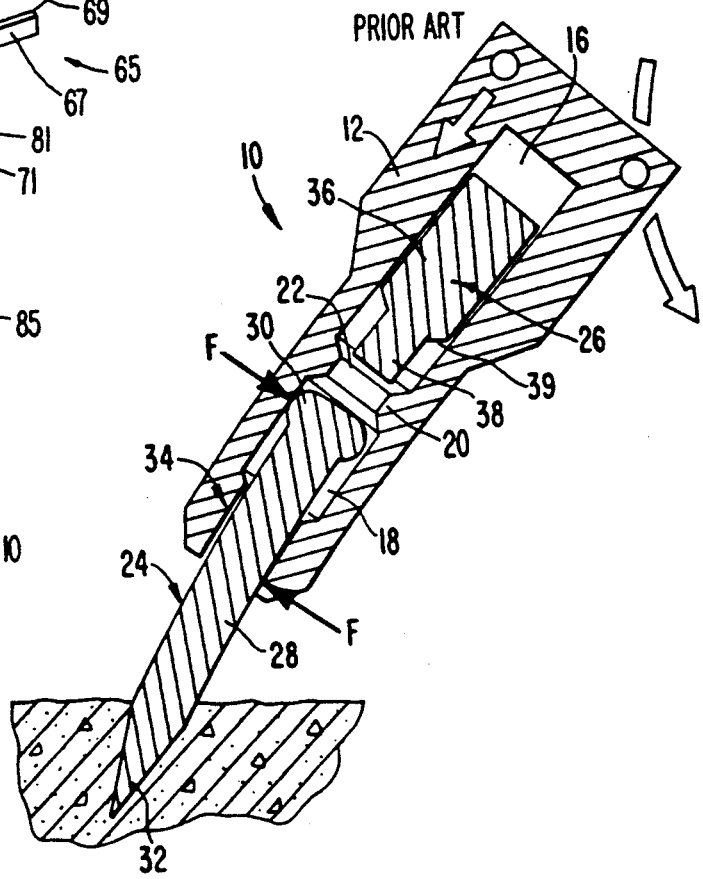
FIG. 14 PRIOR ART
FIG. 14 is a schematic cross sectional side view of a hammer showining the application of forces in the use of a prior art mounting bracket.
Figures 12, 13A, 13B, 13C, 15:
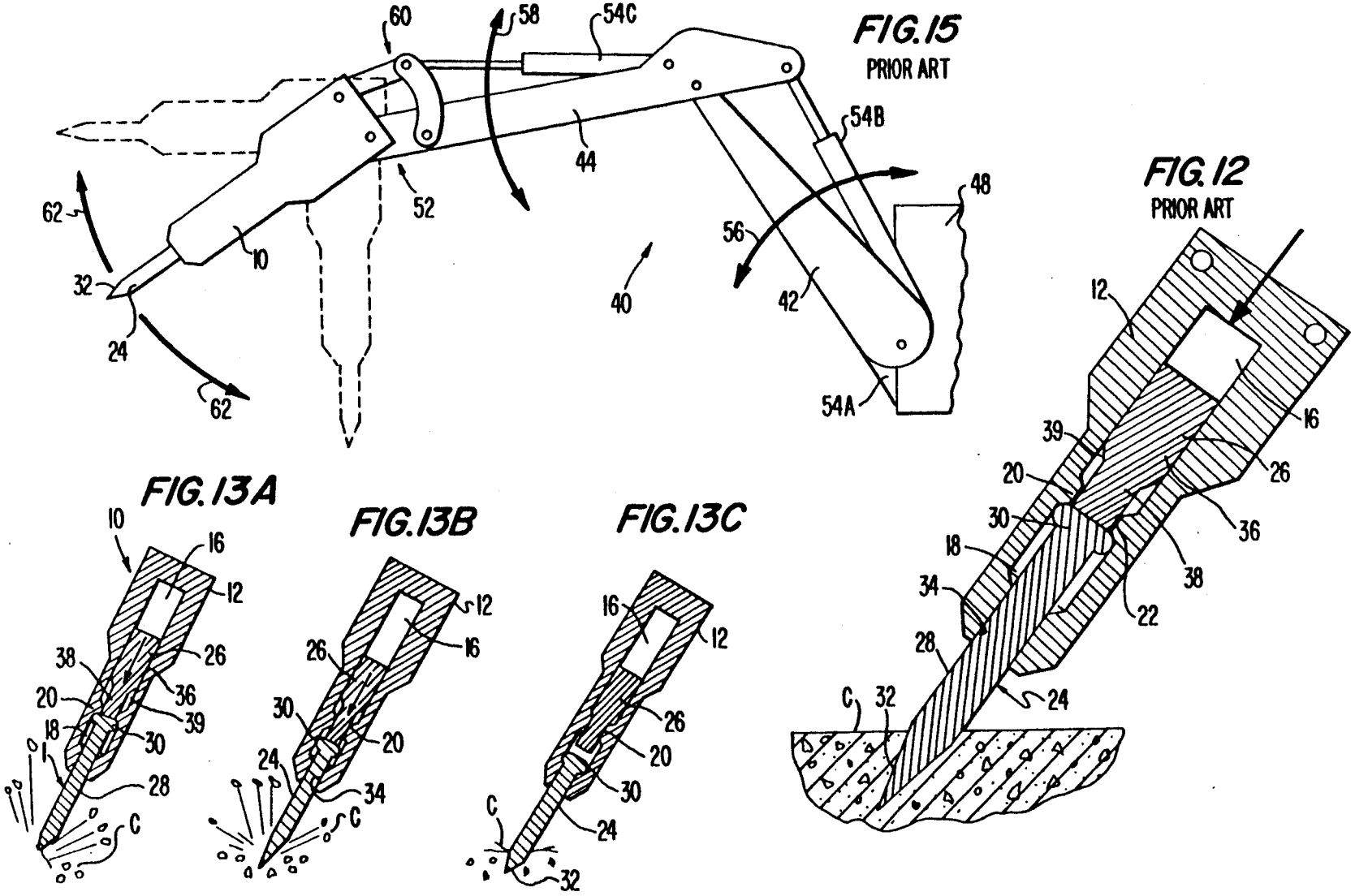
FIG. 12 PRIOR ART
FIG. 15 PRIOR ART
FIG. 12 is a schematic cross sectional side view of a hammer.
FIGS. 13A–13C are schematic cross sectional side views showing the effect of reduced blow energy caused by the hammer piston initially contacting the tool further down the power stroke.
FIG. 15 is a schematic side view illustrating the adjustment capability of a prior art mounting bracket.

When using the hammer to break up concrete or the like in either process, the hammer is first placed at a particular inclination (FIG. 6A). In the present invention, this can be achieved by rotating mounting bracket 90 so that one set of stops 117 is engaged against the corresponding stop portions of base plate 92. In this position, the operator delivers a few blows of piston 26 against tool 24 to partially embed the working end 32 of tool piece 24 within concrete C. Thereafter, the operator rotates mounting bracket 90 so that neither of the stops 117 abut against base plate 92 (FIG. 6B). In this position, a downward force may be continued to be applied against the hammer (FIG. 6C) without causing the binding and generation of side forces experienced in the prior art (FIG. 14). Specifically, although the mounting bracket will continue to swing in the same manner as with the prior art, the mounting bracket 90 is able to swing around the central pin 111 to prevent a lateral pulling on the casing. The applied forces are thus applied in a generally axial direction (FIG. 6C).

Figure 7A:
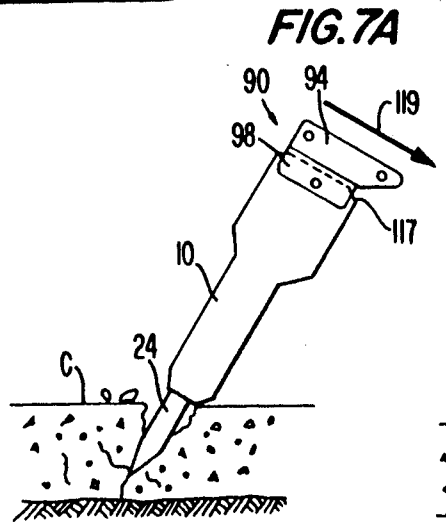
FIGS. 7A and 7B are schematic side views illustrating a prying operation of the present invention.
Figure 7B:
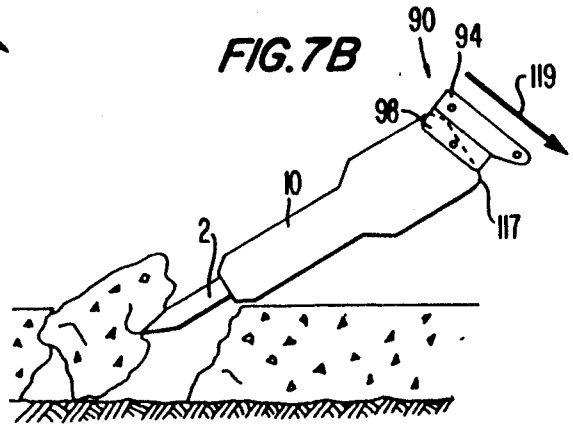

In addition, when desired, the hammer 10 may be used to pry the material to speed its break up (FIGS. 7A and 7B). In the preferred operation for prying a piece of the material (e.g., concrete) to dislodge it from the bearing surface cylinders 54A and/or 54B are actuated to swing the boom in the appropriate direction. With such swinging of the boom the operator can impose large lateral forces to the hammer through pin 111. Continued swinging of hammer 10 in the direction indicated by arrow 119 will thus pry the engaged chunk of material out of its position.

Further, certain jobs, such as driving fence posts, guardrails, trench shoring, grounding rods, forming stakes, pilling, etc., require the impacting hammer to be placed in a vertical orientation. When using the present mounting bracket 90, hammer 10 is easily positioned in a vertical position since the precise orientation of the mounting bracket does not affect the vertical hanging of the hammer, absent engagement with one of the stops 117.

Figure 8:
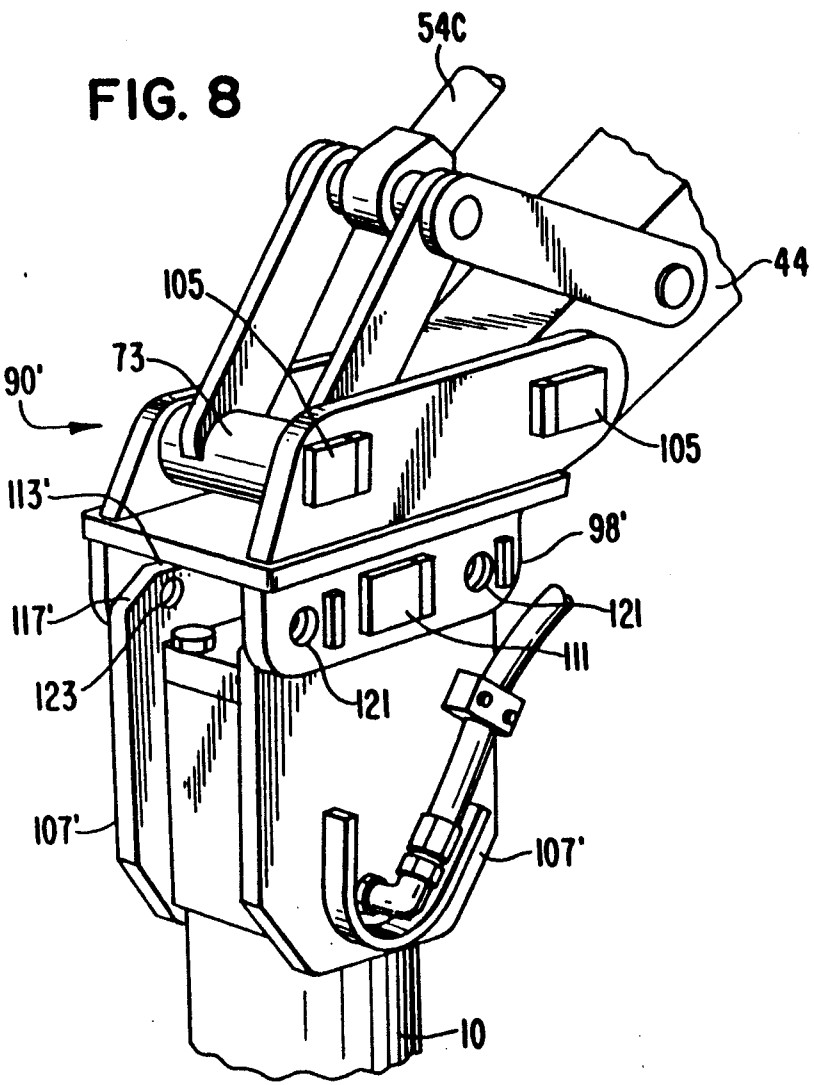
FIG. 8 is a perspective view of an alternative embodiment of the mounting bracket of the present invention.
Figure 11:
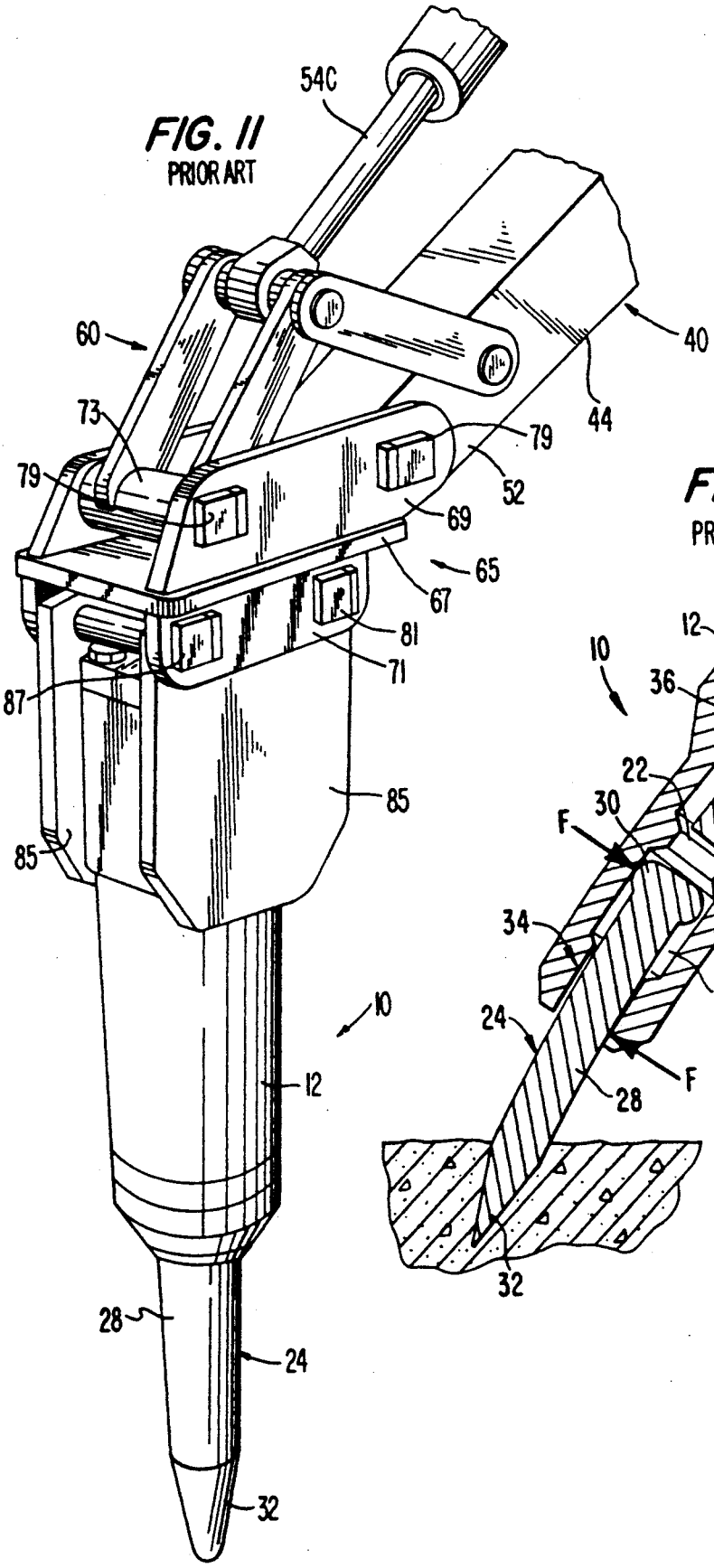
FIG. 11 PRIOR ART
FIG. 11 is a perspective view of a prior art mounting bracket coupling a hammer to the end of a boom.

In an alternative embodiment, mounting bracket 90' is provided with a pair of spaced apart mounting ears 98' each defining a pair of holes 121 in addition to central hole 109' (FIGS. 8 and 9). Although two holes 121 are illustrated, the embodiment could include just one of the holes. In addition, each side plate 107' is also provided with a pair of additional holes 123 (or one hole 123 if only one hole 121 is provided). Holes 121, 123 are positioned so that alignment is possible at a centered orientation of the mounting bracket relative to the hammer. The holes 121, 123 are provided in this embodiment to enable the hammer to be easily accessed for service. Specifically, in use, mounting bracket 90' operates in the same way as mounting bracket 90; that is, with a single pin received only through bore 109'. However, when hammer 10 needs servicing, pin 125 is inserted into one set of the aligned holes 121, 123 (FIGS. 9, 10A and 10B). In the preferred operation, mounting bracket 90' is rotated so that one pin 125 is aligned over the center of gravity CG of the hammer (FIGS. 10A and 10B). In this orientation, the pin 111 can be easily removed since the weight is essentially being supported solely by pin 125 aligned with the center of gravity. Once this pin has been removed, the entire rear end of the hammer may be swung away from the remainder of the casing 12 to permit service to the hammer as required (FIGS. 9 and 10). Alternatively, if a two pin mounting arrangement is desired for a certain operation, pin 111 (which is the same dimension as pin 125) can be inserted into the other set of aligned holes 121, 123 (FIGS. 9, 10A and 10B).

Of course, it is understood that the above disclosures are merely preferred embodiments of the invention, and that various other embodiments as well as many changes and alterations may be made without departing from the spirit and broader aspects of the invention as defined in the claims.

I claim:

1. In a carrier having an articulated boom and a working device for performing work, said boom including at least one arm supported by said carrier and at least one actuator, said arm defining a free end remote from said carrier, said working device being movably attached to said free end of said boom, the improvement comprising a mounting bracket for securing the working device to the free end of the boom, said mounting bracket having a base portion and a mounting portion, said base portion defining a structure to movably attach said mounting bracket to the free end of said arm for controlled pivotal movement effected by said actuator about a base axis, and said mounting portion defining a structure supporting the working device for free pivotal movement about a single axis oriented substantially parallel to said base axis.

2. In a carrier in accordance with claim 1, wherein the mounting bracket further defines a pair of spaced stop portions to limit the free pivotal movement of the working device to a particular range so that said working device can be oriented at an inclination by engagement of said stop portions and said working device.

3. In a carrier in accordance with claim 2, wherein said single axis is defined by a pivot pin coupling said working device to said support structure of said mounting portion.

4. In a carrier in accordance with claim 3, wherein said pivot pin of said mounting bracket is located in substantial vertical alignment with the center of gravity of said working device.

5. In a carrier in accordance with claim 2, wherein said stop portions limit the free pivotal movement of said working device to about thirty degrees.

6. In a carrier in accordance with claim 1, wherein said working device supported by said mounting bracket comprises a hammer.

7. A carrier having an articulated boom and a working device for performing work, said boom including at least one arm supported by said carrier and at least one actuator, said arm defining a free end remote from said carrier, said working device being movably attached to said free end of said boom, the improvement comprising a mounting bracket for securing the working device to the free end of the boom, said mounting bracket having a base portion and a mounting portion, said base portion being movably attached to the free end of said arm for controlled pivotal movement effected by said actuator, and said mounting portion defining a structure supporting the working device for free pivotal movement about a single axis, said mounting portion of said mounting bracket further including at least one auxiliary hole for receiving a pin to facilitate servicing of said working device.

8. A mounting bracket for mounting a working device to a carrier, said mounting bracket comprising means for attaching said bracket to a portion of said carrier for pivotal movement about a first axis and means for attaching said working device to said mounting bracket such that said working device is freely movable relative to said mounting bracket about a second pivot axis substantially parallel to said first axis throughout at least a certain range of movement.

9. A mounting bracket in accordance with claim 8, wherein said means for attaching said working device includes a pivot pin to thereby couple said working device to said mounting bracket for free pivotal movement about said pivot pin.

10. A mounting bracket in accordance with claim 9, which further includes stop means for limiting the free pivotal movement to a specific angular range.

11. A mounting bracket in accordance with claim 10, wherein said specific angular range is about thirty degrees.

12. A mounting bracket in accordance with claim 8, further including stop means for limiting the free movement of said working device to a specific range.

13. A mounting bracket in accordance with claim 12, wherein said working device can freely pivot within a specific range of about thirty degrees.

14. A mounting bracket for mounting a working device to a carrier, said mounting bracket comprising means for attaching said bracket to a portion of said carrier and means for attaching said working device to said mounting bracket such that said working device is freely movable relative to said mounting bracket throughout at least a certain range of movement, said mounting bracket further including at least one auxiliary hole for receiving a pin to facilitate servicing of said working device.

15. A mounting bracket for mounting a working device onto a boom of a carrier, said mounting bracket comprising:

a base;

a plurality of first flanges extending outward from said base in one direction, said first flanges including at least one pair of holes in substantial alignment for receiving a pin to attach said bracket to said boom for pivotal movement about a first axis; and a plurality of second flanges extending outward from said base in a direction opposite said one direction, said second flanges including means for attaching said working device to said second flanges so that said working device is mounted thereto for free pivotal movement about a second axis substantially parallel to said first axis.

16. A mounting bracket in accordance with claim 15, wherein said means for attaching said working device includes a hole defined in each of said second flanges and a pivot pin, and wherein said pivot pin is received through said holes and a portion of said working device.

17. A mounting bracket in accordance with claim 15, wherein said base further defines a plurality of stop portions adapted to selectively engage portions of said working device to limit said free pivotal movement to a specific range.

18. A mounting bracket in accordance with claim 17 wherein said specific range is about thirty degrees.

19. A mounting bracket in accordance with claim 15, in which said first flanges define two pair of spaced apart holes for receiving pins to attach said mounting bracket to the boom of the carrier wherein one pair of holes defines said first axis, and in which said means for attaching said working device includes a single pair of holes defined in said second flanges for receiving a pin therethrough wherein said single pair of holes defines said second axis.

20. A mounting bracket for mounting a working device onto a boom of a carrier, said mounting bracket comprising:

a base:

a plurality of first flanges extending outward from said base in one direction, said first flanges being adapted to attach to said boom; and a plurality of second flanges extending outward from said base in a direction opposite said one direction, said second flanges including means for attaching said working device to said second flanges so that said working device is mounted thereto for free pivotal movement, said means for attaching said working device including a hole defined in each of said second flanges and a pivot pin, said pivot pin being received through said holes and a portion of said working device, said mounting bracket further including at least one additional hole for receiving a pin facilitating servicing of said working device.

* * * * *